United States Patent [19]

Hockridge et al.

[11] Patent Number: 4,938,485

[45] Date of Patent: Jul. 3, 1990

[54] BEAN BAG TOSS GAME

[76] Inventors: Mark R. Hockridge; Gary D. Buck, both of Box 86, Enfield, Me. 04433

[21] Appl. No.: 309,485

[22] Filed: Feb. 13, 1989

[51] Int. Cl.[5] ..... A63B 67/00

[52] U.S. Cl. ..... 273/401; 273/354; 273/402; 273/415; 273/DIG. 30

[58] Field of Search ..... 273/401, 402, 415, 354, 273/DIG. 30

[56] References Cited

U.S. PATENT DOCUMENTS 827,626 7/1906 Gillet ..... 273/402

1,636,920 7/1927 Nichols ..... 273/402

*Primary Examiner*—William H. Grieb

*Attorney, Agent, or Firm*—Leon Gilden

[57] ABSTRACT

A bean bag toss game is set forth wherein a chamber is provided with an overlying opening for acceptance of a bean bag tossed therethrough in a conventional manner with an access door positioned rearwardly of the container for retrieval of bean bags accumulated therewithin. Inserts are provided for positioning within the opening and are formed with hook and loop fasteners associatable with hook and loop fasteners formed about a periphery of the opening to vary the configuration and area of opening to accordingly vary the degree of difficulty in positioning bean bags within the container. A further insert is provided with an inflatable diaphragm positioned interiorly of the insert opening to selectively vary the diametrical opening dimension.

5 Claims, 1 Drawing Sheet

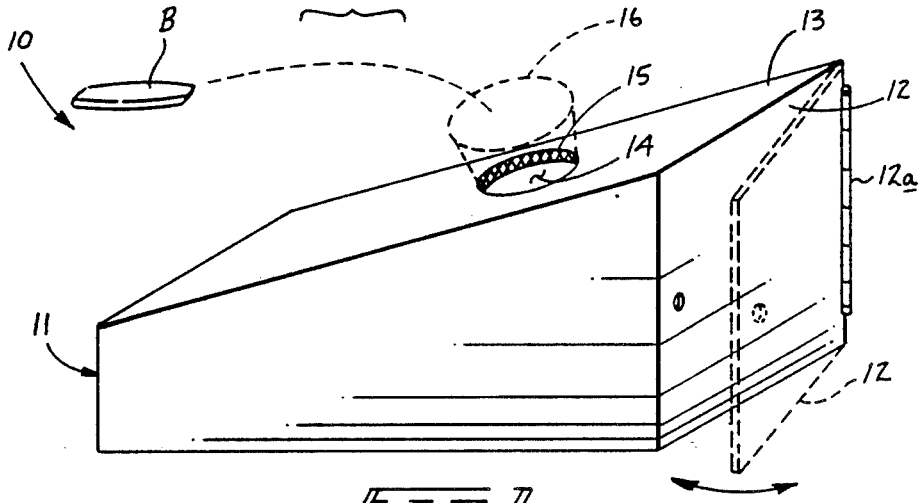
Fig 1
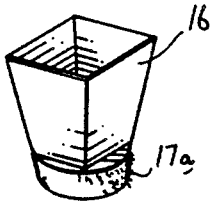
Fig 2
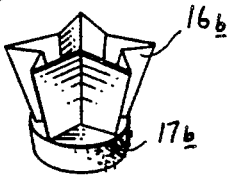
Fig 3
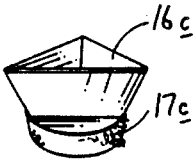
Fig 4
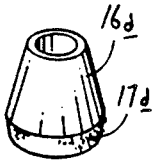
Fig 5
Fig 6
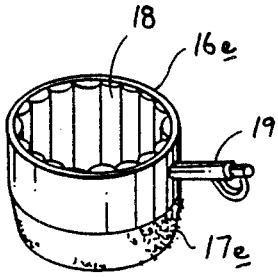
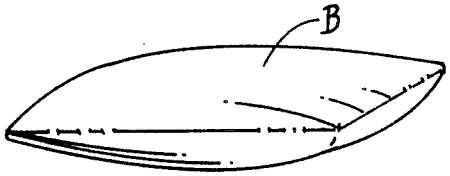
Fig 7

BEAN BAG TOSS GAME

BACKGROUND OF THE INVENTION

1. Field of the Invention

The field of invention relates to bean bag-type games, and more particularly pertains to a new and improved bean bag toss game wherein the same is provided with selective inserts positionable within an opening to vary the area of opening available in the bean bag toss game.

2. Description of the Prior Art

Bean bag toss games are well known in the prior art wherein opponents attempt to position a number of bean bags within a target. Toys and games of the prior art have included varying target-type games in an effort to position a projectile relative to a target. For example, U.S. Pat. No. 3,740,036 to Ames sets forth a spherical type game device wherein the projectile is preferably shaped as a sphere wherein it (the projectile) may be assembled into two more complementary parts during a trajectory to challenge players associated with the game.

U.S. Pat. No. 4,385,881 to Warehime sets forth a plurality of trapezoidally shaped sections assemblable to provide a basket type for association with ball-type projectiles.

U.S. Pat. No. 4,643,438 to Wehby sets forth a game utilizing a disk-shaped projectile directed towards a scoring platform including a plurality of surfaces upon which the projectile may come to rest wherein the plurality of surfaces of the projectile and positioning on the scoring platform determines scoring of the game.

U.S. Pat. No. 1,557,751 to Winks sets forth a toy ball wherein the interior thereof may be pivotally opened to include various items therein whereupon striking a surface of the ball disengages the latch to open the ball.

U.S. Pat. No. 3,117,384 to Billis sets forth a ball utilized as a manipulatable teaching aid wherein the ball is divided into a plurality of sections wherein the article may be assembled into fractional portions and reassembled to form a unified whole wherein the article is disassembled upon a substantial force striking the article utilizing hook and loop fasteners to secure the sections together.

As such, it may be appreciated that there is a continuing need for a new and improved bean bag toss game wherein the same addresses both the problems of adaptability and ease of use, and in this respect the present invention substantially fulfills this need.

SUMMARY OF THE INVENTION

In view of the foregoing disadvantages inherent in the known types of ball toss games now present in the prior art, the present invention provides a bean bag toss game wherein the same utilizes a plurality of inserts of varying geometrical configurations to vary the degree of difficulty in a bean bag entering a target container. As such, the general purpose of the present invention, which will be described subsequently in greater detail, is to provide a new and improved bean bag toss game which has all the advantages of the prior art toss games and none of the disadvantages.

To attain this, the present invention comprises a container formed with an overlying opening and a rearwardly openable door pivotally mounted to a rer of within the container wherein the opening is utilized in combination with one of a plurality of inserts. The inserts are of various configurational shapes to vary the degree of difficulty in obtaining access to the interior of the container upon tossing of a bean bag therein. Further, an insert is provided with an inflatable chamber therewithin to selectively vary the target area available for a bean bag to enter therethrough.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bean bag toss game which has all the advantages of the prior art toss games and none of the disadvantages.

It is another object of the present invention to provide a new and improved bean bag toss game which may be easily and efficiently manufactured and marketed.

It is a further object of the present invention to provide a new and improved bean bag toss game which is of a durable and reliable construction.

An even further object of the present invention is to provide a new and improved bean bag toss game which is susceptible of a low cost of manufacture with regard to both materials and labor, and which accordingly is then susceptible of low prices of sale to the consuming public, thereby making such bean bag toss games economically available to the buying public.

Still yet another object of the present invention is to provide a new and improved bean bag toss game which provides in the apparatuses and methods of the prior art some of the advantages thereof, while simultaneously overcoming some of the disadvantages normally associated therewith.

Still another object of the present invention is to provide a new and improved bean bag toss game therein the same utilizes a plurality of inserts positionable within a target opening to vary the cross-sectional area of the target opening and accordingly vary the degree of difficulty associated with the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIGS. 2 through 5 are isometric illustrations of a variety of inserts positionable within a target opening of the container of FIG. 1.

FIG. 6 is an isometric illustration of an inflatable insert positionable within the target opening of the container of FIG. 1.

FIG. 7 is illustrative of a typical bean bag projectile utilized in the instant invention.

DESCRIPTION OF THE PREFERRED EMBODIMENT

With reference now to the drawings, and in particular to FIGS. 1 to 7 thereof, a new and improved bean bag toss game embodying the principles and concepts of the present invention and generally designated by the reference numeral 10 will be described.

More specifically, it will be noted that the bean bag toss game apparatus 10 essentially comprises a plurality of containers 11. Only one container is illustrated and at least a plurality are utilized in the playing of the game. Inasmuch as the containers are duplicated, one for illustration purposes is deemed adequate.

The container 11 is formed with trapezoidal shaped sides defining a downwardly tapered top surface 13 with a rearwardly positioned door 12 mounted for pivotal movement outwardly of container 11 utilizes an elongate return spring hinge **12*a* of conventional construction for access interiorly of the container 11 for retrieval of bean bags "B". The downwardly sloping top surface 13 is utilized to present the top surface towards an opposing player to individually enhance the target surface including the top surface 13 and the target opening 14 positioned through the top surface 13. The target opening 14 is of a generally cylindrical configuration and is formed with first hook and loop fasteners 16 about the periphery of the opening. An insert 16 is positionable within the opening 14 to vary the target area of the opening to provide varying degrees of difficulty and challenge to players of the game. The insert 16 illustrated in phantom is of an outwardly tapered truncated conical configuration to present a top opening of a diameter greater than that of the opening 14**.

In this same vein, the FIGS. 2 through 5 illustrate the inserts **16*a* of rectangular configuration, 16*b* of star shaped configuration, 16*c* of triangular configuration, and 16*d*** of inwardly tapered truncated conical configuration to present varying target areas of various and challenging opening shapes and acceptance areas of an associated bean bag "B".

Each insert includes a downwardly tapered truncated conical base **17*a* formed with second hook and loop fasteners cooperating with the first hook and loop fasteners 15. In this manner, the inserts 16 through 16*e* may be positioned at varying angles relative to the top surface 13 to further vary the degree of difficulty in attempting to toss a bean bag "B" and direct same through the associated opening 14 of a target container 11**.

The insert **16*e* is of a cylindrical configuration formed with a companion base 17*e* wherein the insert 16*e* includes an inflatable diaphragm 18 therewithin including an inflation valve 19 projecting through the side wall of the insert 16*e* whereby the diaphragm 18 may be inflated to selectively vary the opening area of the insert 16*e*. The diaphragm 18 is formed of a resilient polymeric-type material and is of continuous construction about the interior surface of the cylindrical insert 16*e***.

The playing of the game merely involves opposing players to direct as many bean bags "B" as possible through the opening 14 of a target container 11. The winner is the player with the greatest number of bean bags "B" deposited within the container 11 which may be thereafter withdrawn through the door 12.

As to the manner of usage and operation of the instant invention, the same should be apparent from the above description and accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A bean bag toss game apparatus comprising, at least one container defining an interior compartment, and a target opening comprising a through-extending aperture extending through a top surface of said container, and at least one bean bag means for use as a projectile to enter said interior compartment through said target opening, and insert means selectively positionable in said target opening to provide a varying target opening area and configuration, and wherein said insert defines an outwardly tapering configuration including an integrally formed base, and wherein said base is of a downwardly tapering truncated conical configuration, and wherein said base further includes an outer peripheral surface including hook and loop fasteners integrally formed thereon cooperative with further hook and loop fasteners formed on a peripheral surface of said target opening wherein said base may be positioned at varying angles relative to said target opening.

2. A bean bag toss game apparatus as set forth in claim 1 wherein said top surface of said container is downwardly tapering and opposed elongate side walls of said container are of a generally trapezoidal shape to accommodate said top surface.

3. A bean bag toss game apparatus as set forth in claim 2 wherein said container includes an access door pivotally mounted to define a rear wall of said container and wherein said door further includes a spring-biased hinge to maintain said door in normally closed position.

4. A bean bag toss game apparatus comprising, at least one container defining an interior compartment, and a target opening comprising a through-extending aperture extending through a top surface of said container, and at least one bean bag means for use as a projectile to enter said interior compartment through said target opening, and insert means selectively positionable in said target opening to provide a varying target opening area and configuration, and wherein said insert means includes a cylindrical insert including a downwardly tapering truncated conical configuration formed with peripheral hook and loop fasteners to cooperate with further hook and loop fasteners formed about a periphery defined by said target opening, and said insert means further includes an expandable pneumatic chamber positioned interiorly of said insert means to selectively vary an opening defined by said insert means to enable access to said interior compartment.

5. A bean bag toss game apparatus as set forth in claim 4 wherein said insert means further includes an inflation valve extending through a side wall defined by said insert to selectively expand said pneumatic chamber.

* * * * *